US006591450B2

(12) United States Patent
Gardner

(10) Patent No.: US 6,591,450 B2
(45) Date of Patent: Jul. 15, 2003

(54) DOOR HINGE

(76) Inventor: Stewart Gardner, 17812 County Rd. 10, Bristol, IN (US) 46507

( * ) Notice: Subject to any disclaimer, the term of this patent is extended or adjusted under 35 U.S.C. 154(b) by 0 days.

(21) Appl. No.: 09/992,557

(22) Filed: Nov. 14, 2001

(65) Prior Publication Data

US 2003/0088942 A1 May 15, 2003

(51) Int. Cl.[7] ..... E05D 5/10
(52) U.S. Cl. ..... 16/235; 16/386
(58) Field of Search ..... 16/235, 239, 356, 16/357, 361, 367, 386, 248, 249, 242, 243, 387

(56) References Cited

U.S. PATENT DOCUMENTS 2,248,372 A * 7/1941 May ..... 16/240
3,832,754 A * 9/1974 Maertin et al. ..... 16/224
3,832,755 A * 9/1974 Maertin et al. ..... 16/309
4,864,690 A * 9/1989 Chen ..... 16/276
5,832,565 A * 11/1998 Smith ..... 16/235
5,956,809 A * 9/1999 Hodgson ..... 16/224

* cited by examiner

*Primary Examiner*—Anthony Knight
*Assistant Examiner*—Doug Hutton
(74) *Attorney, Agent, or Firm*—Botkin & Hall, LLP

(57) ABSTRACT

An assembly which includes a door pivotably connected by hinge members to a wall part. Each hinge member includes a knuckle and a pin with the knuckle being connected to either the door or the wall part and the pin being connected to the other of the door or wall part. The knuckle includes a cylindrical opening and the pin is constructed with a central ball part and oppositely extending shanks. The pin is fitted into the knuckle cylindrical opening with the ball part fitting closely or snugly within the opening and the shanks having a free fit within the cylindrical opening. The ball part is rotatable relative to the knuckle with the shanks of the pin being shiftable transversely within the knuckle cylindrical opening to accommodate misalignment between the pin and knuckle.

6 Claims, 8 Drawing Sheets

DOOR HINGE

SUMMARY OF THE INVENTION

This invention relates to a door hinge and will have particular application to a form of hinge which allows misalignment of the hinge components.

Heretofore, if the axis of rotation of the hinge pins within the hinge knuckles were misaligned, the door would bind and not fit properly into a sealed position relative to the wall opening. This was particularly an acute problem with contoured doors in which the pivot axis of the hinges are many times not in vertical alignment.

In this invention the hinge member is designed so that the pin has an enlarged central portion, somewhat in the shape of a ball, with oppositely extending coaxial shank portions. The ball portion of the pin fits snugly within the cylindrical opening of the knuckle to allow essentially fixed journalled rotating movement of the pin relative to the knuckle while the free fitting shanks of the pin within the knuckle allow a tilting movement of the pin relative to the knuckle. In this manner misalignment of the axes of the pins can be accommodated so as to allow free and precise pivotal movement of the door about its hinge members.

Accordingly, it is an object of this invention to provide a hinge member for a door which accommodates vertical misalignment of the pin relative to the receiving knuckle of the hinge member.

Another object of this invention is to provide in combination a door having its hinge members able to accommodate misalignment of the pins of the hinge members.

Other objects to this invention will become apparent upon a reading of the following description.

BRIEF DESCRIPTION OF THE DRAWINGS

A preferred embodiment of this invention has been chosen for purposes of illustration wherein.

DESCRIPTION OF THE PREFERRED EMBODIMENT

A preferred embodiment has been chosen for purposes of illustration and description so as to enable one having ordinary skill in the art to make and use the invention.

Figure 1:
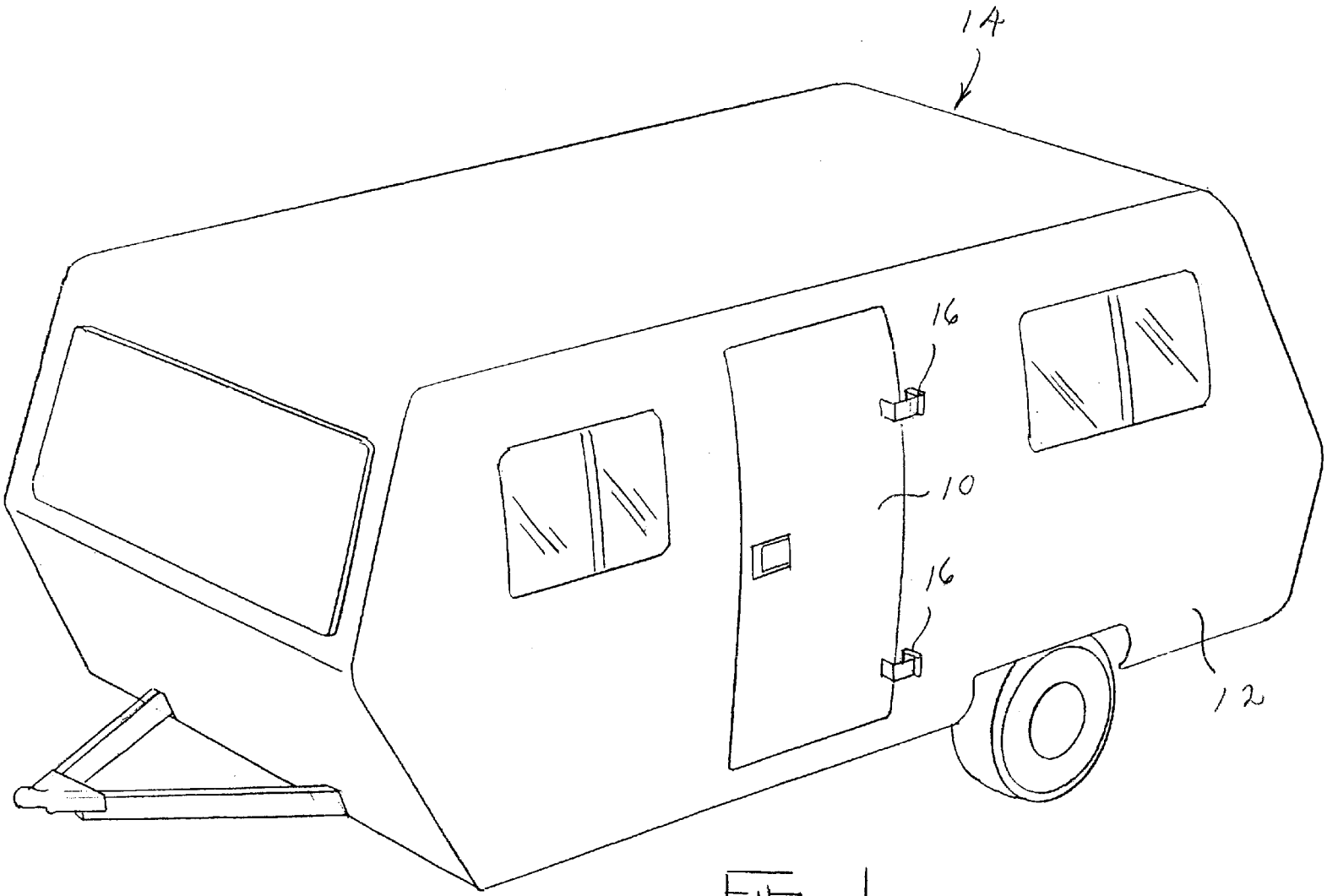
FIG. 1 is a perspective view a trailer showing a door mounted to the sidewall of the trailer by the hinge members of this invention.
Figure 3:
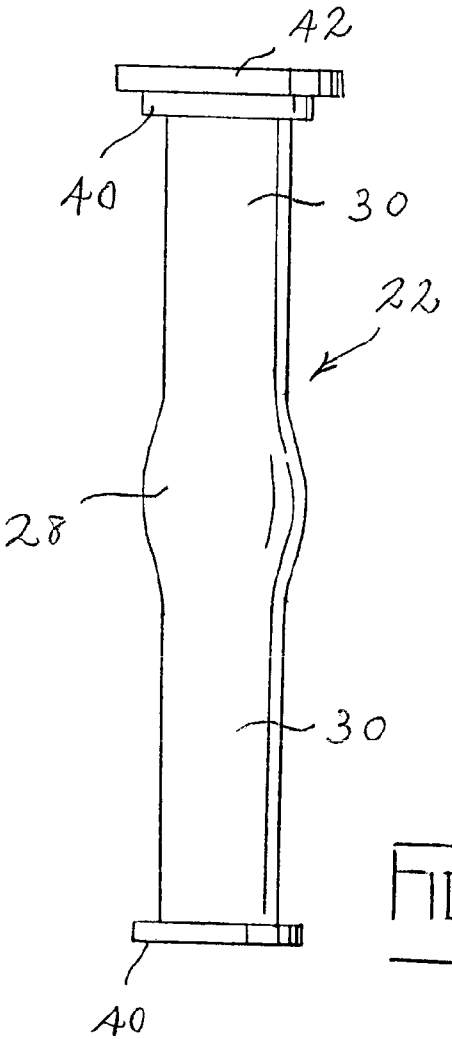
FIG. 3 is an elevational view of the pin of the hinge member.
Figure 2:
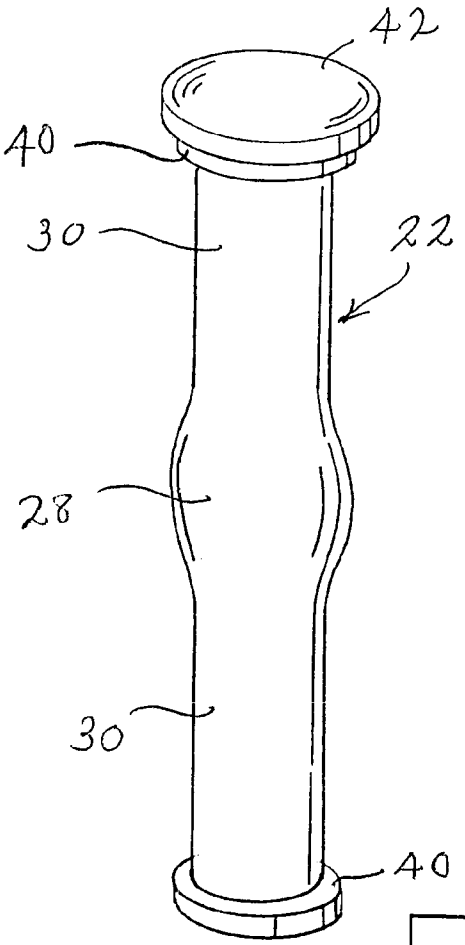
FIG. 2 is a perspective view of the pin of the hinge member.
Figure 6:
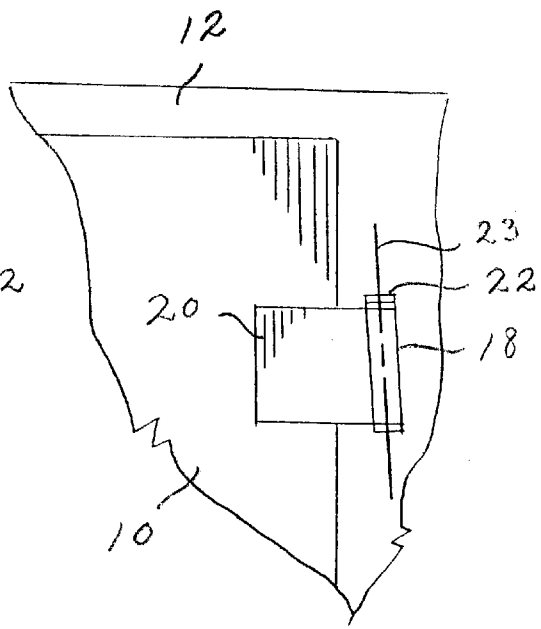
FIG. 6 is a view of the hinge member connecting a door to the sidewall showing the pin thereof misaligned to the left.
Figure 5:
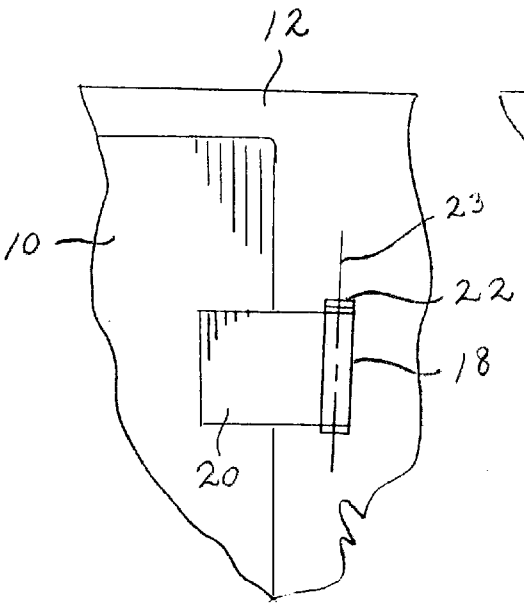
FIG. 5 is a view of the hinge member connecting a door to the sidewall showing the pin thereof misaligned to the right.
Figure 4:
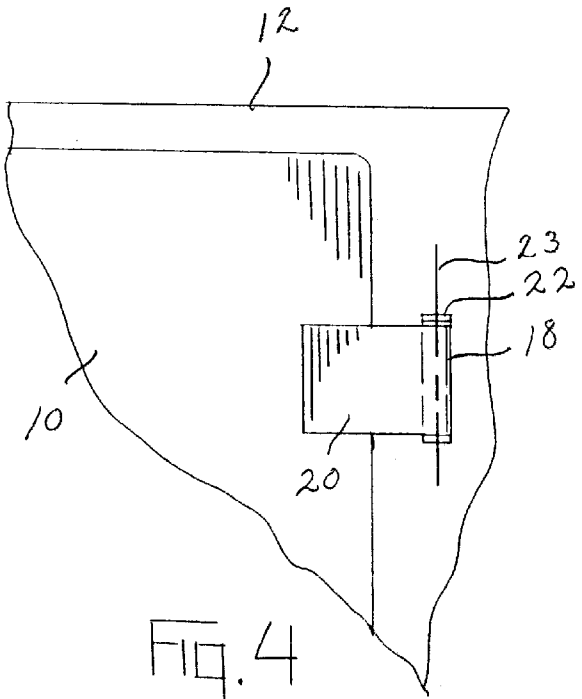
FIG. 4 is a fragmentary view showing the hinge member connecting a door to a sidewall with the pin in vertical orientation.
Figures 7, 8, 9:
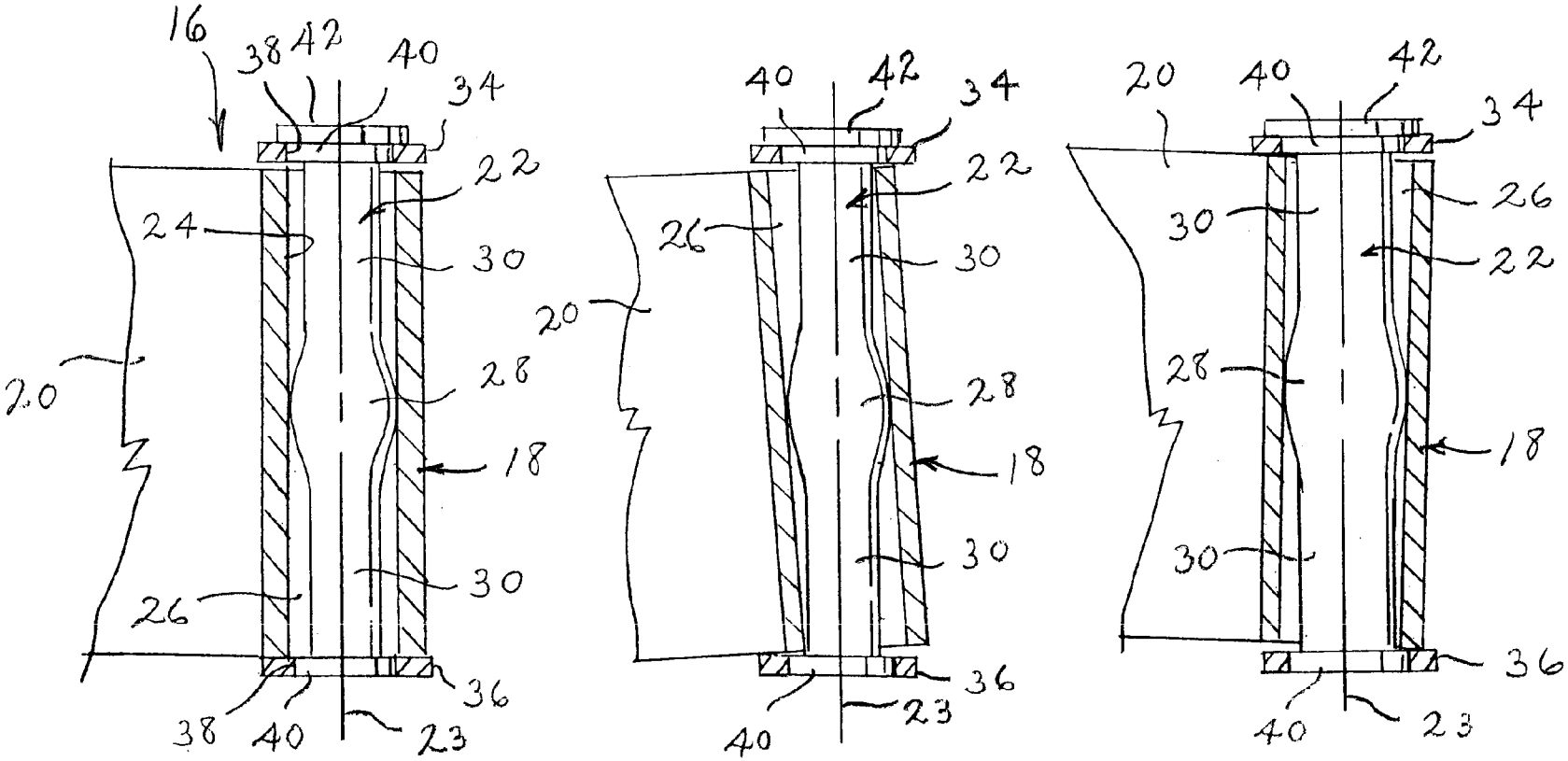
FIG. 7 is a fragmentary sectional view of the hinge member as seen from the front as in FIG. 4.
FIG. 8 is a fragmentary sectional view of the hinge member showing the knuckle thereof being misaligned to the left.
FIG. 9 is a fragmentary sectional view of the hinge member showing the knuckle thereof being misaligned to the right.
Figure 12:
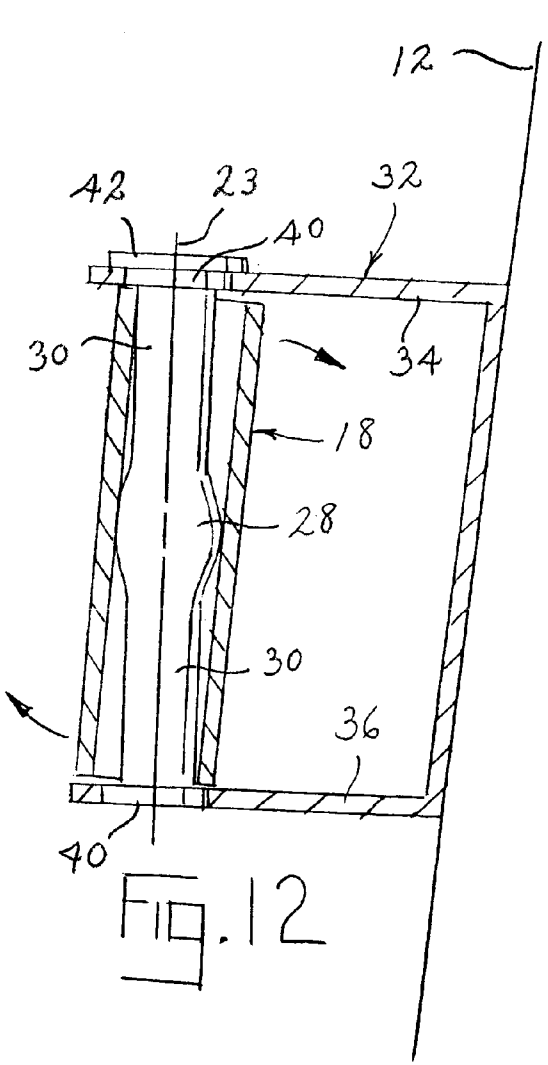
FIG. 12 is a sectional view of the hinge member as seen from the side showing the knuckle being misaligned inwardly or to the right.
Figure 11:
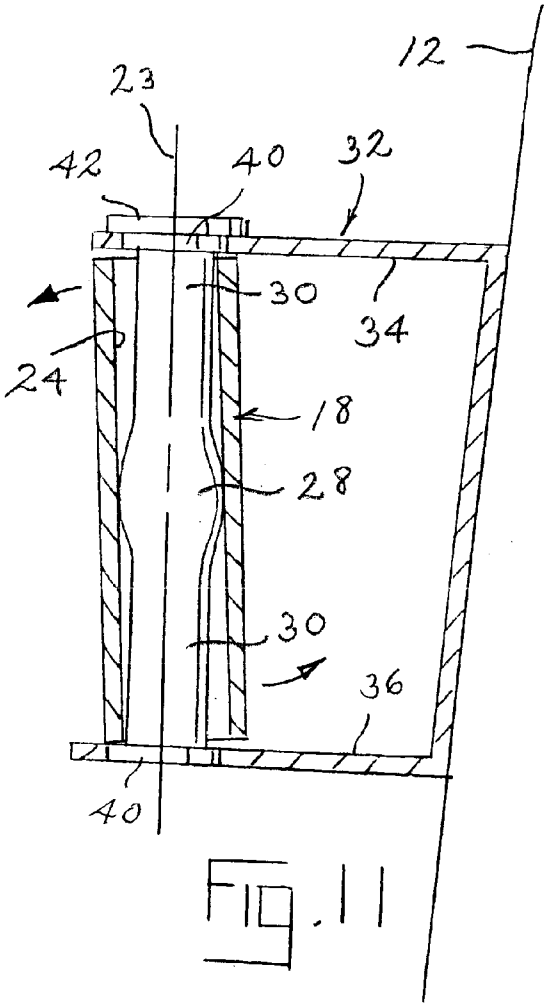
FIG. 11 is a sectional view of the hinge member as seen from the side showing the knuckle of the hinge member being misaligned outwardly or to the left.
Figure 10:
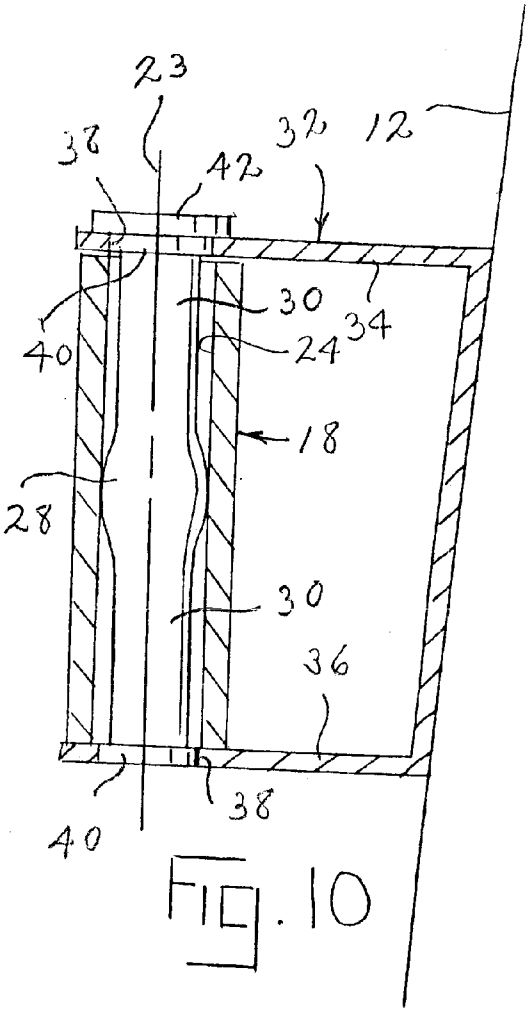
FIG. 10 is a sectional view of the hinge member as seen from the side showing the pin and knuckle in vertical orientation.

Door 10 is shown in FIG. 1 is mounted to the sidewall 12 of the recreational vehicle 14 through hinge members 16 of this invention. Each hinge member 16 includes a pin 22 and a knuckle 18 having a connecting mounting plate 20. Knuckle 18 is of tubular form having an internal sidewall 24 defining a cylindrical opening 26 through the knuckle. Pin 22 has an axis 23 and includes an enlarged central portion or ball part 28 and oppositely extending coaxial shanks 30. Pin 22 is secured to the underlying supporting structure, in this case sidewall 12, by a mounting bracket 32. Mounting bracket 32 is best seen in FIGS. 10–12 and is of a generally C-shaped configuration. Each mounting bracket 32 includes an upper flange 34 and a lower flange 36. Flanges 34 and 36 have aligned openings 38 which receive pin 22. Each pin 22 includes a collar 40 at the free end of each of its shanks 30. At the top of each pin 22 is a head 42 of larger diametrical dimension than the underlying collar 40. When pin 22 is inserted into its mounting bracket 32, collars 40 of the pin fit snugly within openings 38 in the bracket with head 42 of the pin resting upon upper flange 34 of the bracket so as to locate and fix the pin within the bracket.

Figure 15:
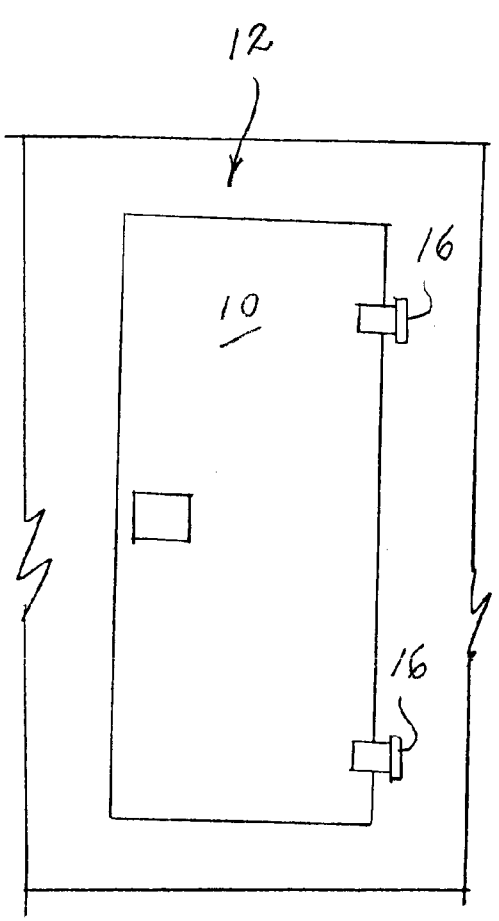
FIG. 15 is a front elevational view of a door connected to a wall with the hinge members being offset to the right in vertical orientation.
Figure 14:
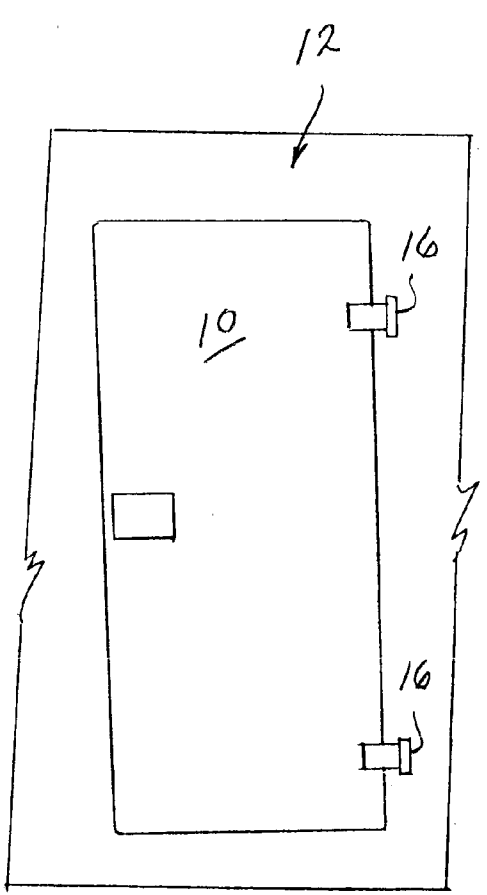
FIG. 14 is a front elevational view of a door mounted to a wall with the hinge members being offset to the left in vertical orientation.
Figure 13:
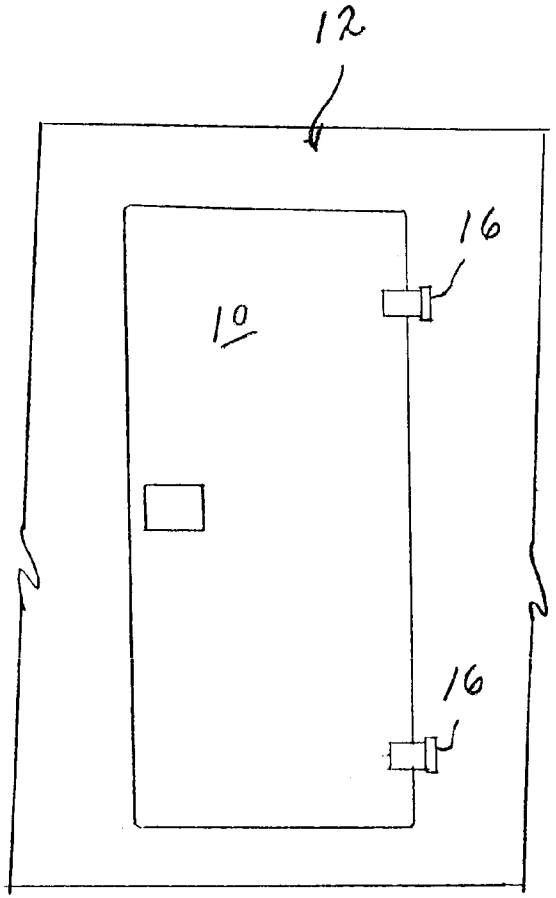
FIG. 13 is a front elevational view of a door mounted to a wall with the hinge members being in vertical orientation.

In the illustrated embodiment, each knuckle 18 is connected by its mounting plate 20 to door 10 while each pin is connected to the underlying sidewall 12 by its bracket 18. The knuckle and bracket may be secured to their supporting structures by suitable fasteners or by welding. To assemble hinge member 16, knuckle 18 is located between flanges 34 and 36 of the support bracket 32 with its opening 26 aligned with openings 38 in the bracket. A pin 22 is then inserted downwardly through upper opening 38 in flange 34 of the bracket, opening 26 in the knuckle, an into lower opening 38 in flange 36 until head 42 of the pin rests upon the upper flange 34 of the bracket, thus securing the pin and knuckle. Ball part 28 of each pin 22 fits snugly within opening 26 in the receiving knuckle 18 so as to allow journalled bearing movement between the ball part and inner sidewall 24 of the knuckle with preferably no appreciable slack. The diametrical dimension of each of the shanks 30 of the pin is appreciably less than the diameter of opening 26 in the knuckle so as to allow the shanks to fit freely with substantial clearance within knuckle opening 26. This allows transverse or lateral movement of the pin relative to the knuckle as illustrated in FIGS. 8 and 9 and 11 and 12 to accommodate misalignment between the knuckle and pin while permitting fixed rotating movement between the knuckle and pin. In this manner the vertical angular relationship between the pin and the knuckle can vary as depicted in FIGS. 8, 9, 11 and 12 to accommodate variations in the angular relationship of the door to the wall opening as indicated in FIGS. 13–15. This is particularly significant when hanging contoured doors, some of which utilize three hinges in which even under the best of circumstances the axes of the hinges will not be vertically aligned.

Figure 16:
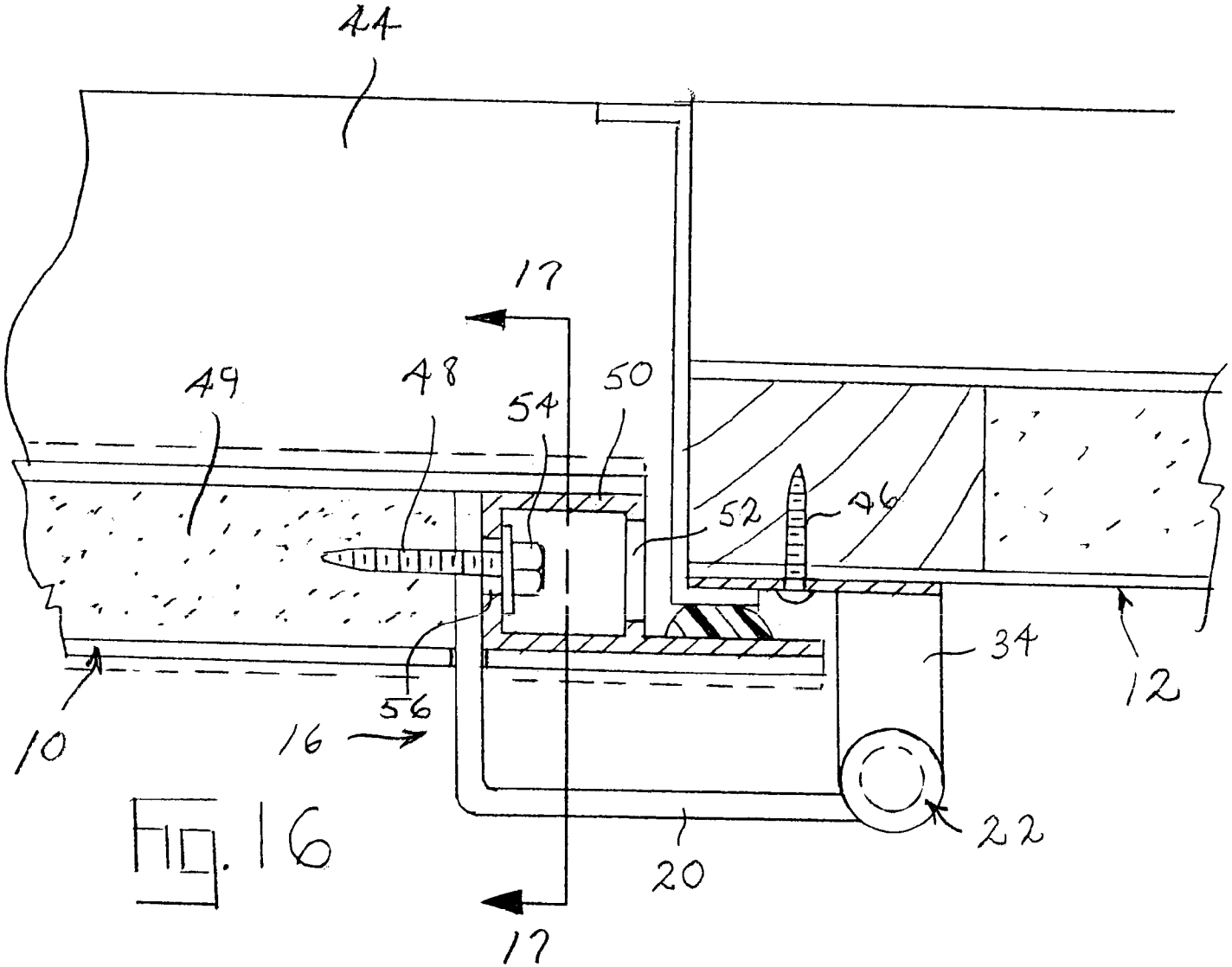
FIG. 16 is a detailed cross sectional view of the hinge member mounted to a contoured door and shown in fragmentary form.
Figure 17:
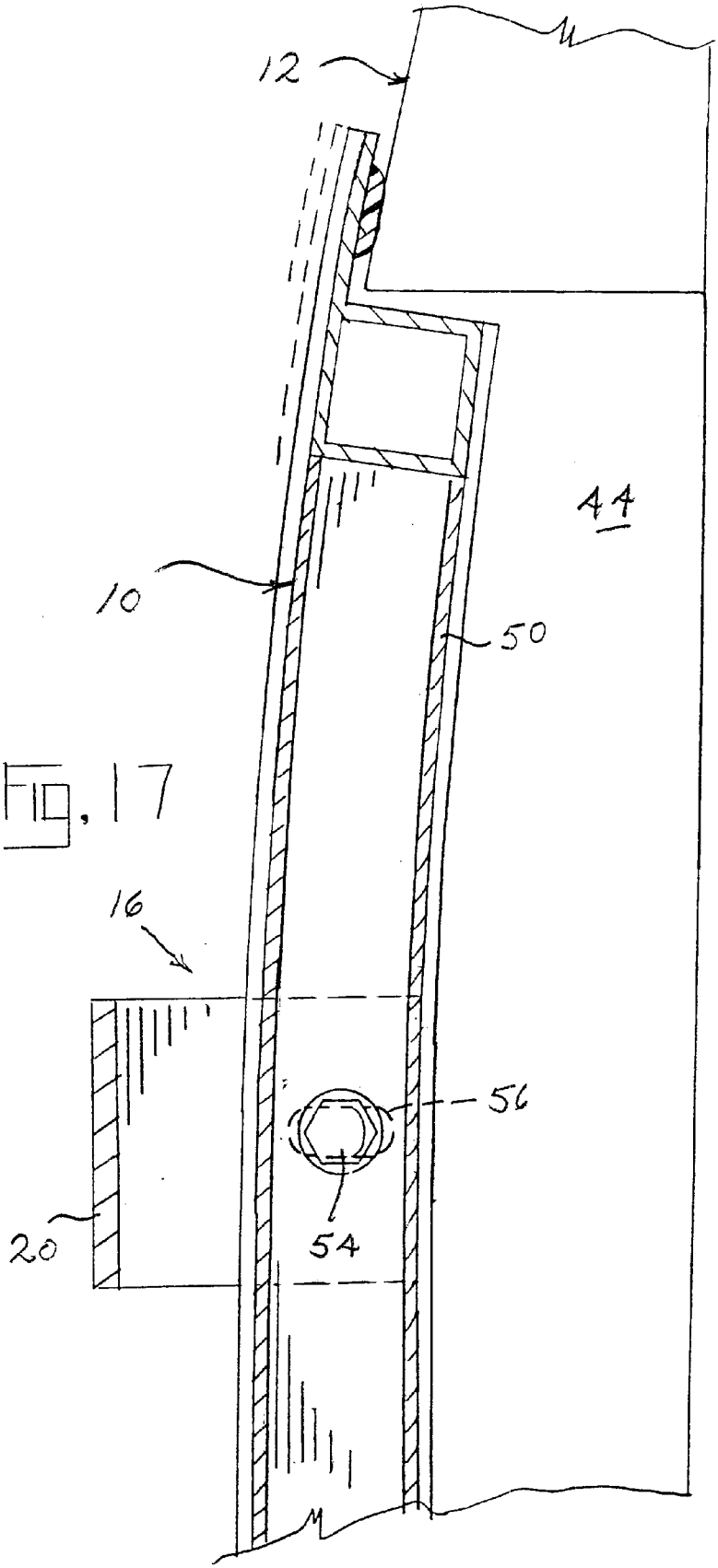
FIG. 17 is a sectional view of FIG. 16 shown in fragmentary form taken along line 17—17 of FIG. 16.

In FIGS. 16 and 17 a hinge member 16 is shown secured between door 10 and wall 12 with the door spanning opening 44 in the side wall. In this illustration a fastener 46 secures the mounting bracket 32 for the pin to sidewall 12 and a fastener 48 is threaded into mounting plate 20 for the knuckle. Fastener 48 protrudes onto the foam core 49 of the door and serves to draw plate 20 against frame 50 of the door, securing the plate to the door. The head 54 of fastener 48 is recessed within a tubular frame 50 which forms a part of door 10. An access opening 52 is formed in frame 50 in an oppositely located orientation from the head 54 of the fastener. The opening 56 in tubular frame member 50 is enlarged so as to enable fastener 48 to be loosened and bracket 20 to be shifted relative to frame 50 and core 49 with the attached fastener, thereby providing additional adjustment for knuckle 18 connected to bracket 20. Fastener 48 is retightened after the door has been positioned in final alignment with opening 44 of sidewall 12.

The invention is not to limited to the details above given but may be modified within the scope of the appended claims.

I claim:

1. An assembly comprising a door, a plurality of hinge members connected between said door and a wall part having an opening therein to allow the door to be pivoted through the hinge members between a position spanning said wall part opening and a position exposing the wall part opening, each hinge member including a knuckle connected to one of said door and said wall part, each hinge member further including a pin assembly connected to the other of said door and said wall part, each knuckle having an internal sidewall defining a cylindrical opening, each pin assembly having a pair of opposed spaced flanges attached to said other door and wall part and a pin including an axis, said pin having an intermediate ball part and opposing extending shanks, said knuckle fitting between said flanges, wherein each pin is fitted slidably within said flanges and said knuckle cylindrical opening with said ball part thereof having a snug fit within said knuckle sidewall and said shanks thereof fitting freely within the sidewall, said pin being rotatable about its axis relative to said knuckle and being shiftable transversely at its shanks relative to the knuckle about said pin ball part, said pin shanks being aligned along said pin axis, said flanges having opposing openings therethrough for supporting said pin, a first collar carried by one of said shanks fitted into the top opening of said top flange and a second collar carried by the other of said shanks snugly fitted into the bottom opening of said bottom flange, one of said collars fitting slidably through said knuckle cylindrical opening.

2. The assembly of claim 1 wherein said pin shanks are aligned along said pin axis.

3. The assembly of claim 2 wherein said knuckles are connected to said door and said pins are connected to said wall part.

4. The assembly of claim 3 wherein said door includes a central core and a bordering tubular frame member, said knuckles including a mounting plate, said mounting plate inserted between said core and said frame member, said frame member having aligned opening from the exterior of the frame member to said mounting plate, a fastener located within said tubular member and extending through one of said frame member openings into said mounting plate and said core, said fastener being anchored in said mounting plate and abutting said frame member while fitting with a clearance through said one frame member opening, said other frame member opening allowing access to said fastener for loosening the fastener relative to said frame member to allow movement of the mounting plate relative to the door as allowed by the clearance of the fastener in said one frame member opening.

5. A hinge for connection between a door and a wall, said wall having an opening therein, said door being pivotal through said hinge between a position spanning said wall opening and a position exposing said wall opening, said hinge comprising a knuckle and a pin assembly, said knuckle connected to one of said door and said wall, said pin assembly connected to the other of said door and said wall, said knuckle having an internal sidewall defining a cylindrical opening, said pin assembly having a pair of vertically oriented opposed spaced top and bottom flanges attached to said other of said door and wall and a pin including an axis, said pin having an intermediate ball part and opposing extending shanks, said knuckle fitted between said flanges, wherein said pin is fitted slidably within said opposing flanges and said knuckle cylindrical opening with said ball part thereof having a snug fit within the knuckle sidewall and said shanks thereof fitting freely within said sidewall, said pin being rotatable about its axis relative to said knuckle and being shiftable transversely at its shanks relative to said knuckle about said pin ball part, said pin shanks being aligned along said pin axis, said flanges having opposing openings therethrough for supporting said pin, a first collar carried by one of said shanks fitted into the top opening of said top flange and a second collar carried by the other of said shanks snugly fitted into the bottom opening of said bottom flange, one of said collars fitting slidably through said knuckle cylindrical opening.

6. The hinge of claim 5, said pin further including a head on the other of said collars being larger than said other collar and the top said flange opening, wherein said head abuts said top flange thereby preventing said pin from sliding completely through said top flange opening.

* * * * *